US006548963B2

(12) United States Patent
Van Casteren et al.

(10) Patent No.: US 6,548,963 B2
(45) Date of Patent: Apr. 15, 2003

(54) CIRCUIT DEVICE

(75) Inventors: Dolf Henricus Jozef Van Casteren, Eindhoven (NL); Oscar Jan Deurloo, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/940,040

(22) Filed: Aug. 27, 2001

(65) Prior Publication Data

US 2002/0047598 A1 Apr. 25, 2002

(30) Foreign Application Priority Data

Aug. 28, 2000 (EP) ..... 00202967

(51) Int. Cl.[7] ..... H05B 37/02
(52) U.S. Cl. ..... 315/209 R; 315/194
(58) Field of Search ..... 315/209 R, 307, 315/308, 224, DIG. 7, 105, 106, DIG. 5, 291

(56) References Cited

U.S. PATENT DOCUMENTS 5,623,187 A 4/1997 Caldeira et al. ..... 315/307
5,828,178 A 10/1998 York et al.
5,872,429 A * 2/1999 Xia et al. ..... 315/194

FOREIGN PATENT DOCUMENTS

EP 0567108 A1 4/1993 ..... H05B/41/29

* cited by examiner

*Primary Examiner*—Don Wong
*Assistant Examiner*—James Clinger

(57) ABSTRACT

The invention relates to a circuit for operating a high-pressure discharge lamp, which circuit is provided with means for operating the connected lamp in a dimmed state by means of a dimming signal Ds. The circuit is provided with:

Figure 1:
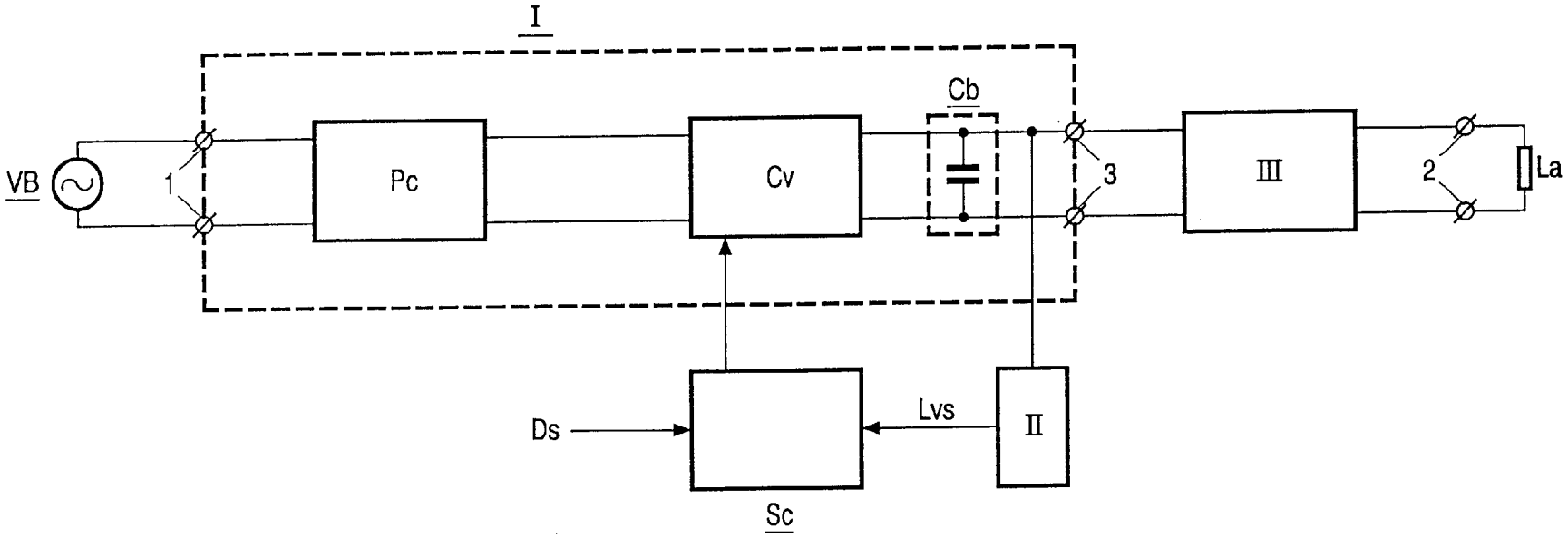

input terminals for connecting the circuit to a power supply source, output terminals for connecting the lamp to be operated, a switch-mode power supply (smps) having a converter provided with a semiconductor switch for generating a converter output voltage across buffer capacitor means, and a control circuit for generating a control signal in dependence on the dimming signal Ds for controlling the semiconductor switch.

According to the invention, the circuit is further provided with means for generating a converter output voltage-related signal Lvs for monitoring stable lamp operation by limiting the dimmed state by means of the control circuit. In conjunction with the converter output current, continuous lamp power control results in an improvement of the stable lamp operation over the full power range of the lamp.

20 Claims, 7 Drawing Sheets

CIRCUIT DEVICE

The invention relates to a circuit device for operating a high pressure discharge lamp with successive current phases, which circuit device is provided with means for operating the connected lamp in a dimmed state by means of a dimming signal Ds, which circuit device comprises:

- input terminals for connecting the circuit device to a power supply source,
- output terminals for connecting the lamp to be operated,
- a switch-mode power supply (smps) with a converter provided with a semiconductor switch for generating, at a converter output, a converter output voltage across buffer capacitor means and a converter output current, and
- a control circuit for generating a control signal in dependence upon the dimming signal for controlling the semiconductor switch.

A circuit device of the type mentioned in the opening paragraph is known from U.S. Pat No. 5,828,178. In general, high-pressure discharge lamps are operated using successive current phases of periodically alternating polarity. In a frequently applied structure of the circuit device, the converter is connected, for this purpose, to a commutator, for example, in the form of a bridge circuit.

In the known circuit device, an optical sensor is provided for detecting light generated by the lamp. This enables a control for dimming the lamp to be realized.

The known dimming system for high-pressure discharge lamps, however, has a number of serious practical drawbacks. One serious drawback relates to the use of an optical sensor. On the one hand, because in order to properly detect the light generated by the lamp, correction for ambient light is required and, on the other hand, because such a detection is very sensitive to soiling of the sensor. An additional, frequently encountered problem relates to the fact that the lamp readily starts to flicker, which is visually very disturbing. Besides, there is a substantial risk that the lamp will cease burning during dimming or in the dimmed state. Another frequently encountered drawback relates to the fact that operation of the lamp in a dimmed state leads to blackening of the wall of the discharge vessel, causing the luminous flux of the lamp to decrease in the course of the service life of the lamp.

It is an object of the invention to provide a measure by means of which said drawbacks are counteracted.

To achieve this, a circuit device of the type mentioned in the opening paragraph is characterized, as a circuit device in accordance with the invention, in that the circuit device is provided with means for generating a converter output voltage-related signal Lvs to form the control signal.

The circuit device in accordance with the invention has the advantage that signal formation takes place on the basis of voltage measurement instead of optical registration. A further advantage is that registration of the value and duration of the converter output voltage appears to be very suitable for detecting the maximum permissible dimmed state at which the lamp is still stable in operation, by comparing the detected signal with a limit value. At the beginning of each current phase, the converter output voltage generally is pulse-shaped with a pulse height and a pulse width, followed by a plateau voltage. Thus, in a favorable embodiment, the signal Lvs serves to detect the pulse height. In a different embodiment, the signal Lvs is used to detect the pulse width.

In a further embodiment of a circuit device in accordance with the invention, the signal Lvs serves to detect the plateau voltage. In a first modification, detection of the difference in plateau voltage of the signal Lvs in successive current phases takes place. In another modification, detection of fluctuations in the plateau voltage of the signal Lvs within one current phase takes place.

In the operating state, the converter carries the converter output current at its output. In an advantageous embodiment in accordance with the invention, the circuit device comprises means for generating a converter output current-related signal Icu, which is intended to form the control signal. Surprisingly, it has been found that controlling the semiconductor switch of the converter on the basis of both the converter output voltage and the converter output current enables a connected high-pressure discharge lamp to be operated in a stable manner over a large dimming range. Preferably, the signals Lvs and Icu are used to form a power signal Sv, for example by multiplying the signals Lvs and Icu. The power signal Sv is subsequently compared to a reference power value which depends upon the dimming signal Ds, and the result of the comparison is used to form the control signal for controlling the semiconductor switch of the converter. Detection of the maximum permissible dimmed state can be advantageously realized by limiting the value of the power signal Sv immediately after the start of each current phase.

Periodic detection of the converter output voltage and the converter output current enables a software-based approach, resulting in a substantial degree of freedom regarding the practical realization of the hardware. Preferably, the control circuit comprises a programmable processor, which is used to carry out one of the above-mentioned functions. Said control circuit preferably comprises means for comparing the signal Lvs to a limit value. This can be advantageously carried out by means of the programmable processor.

If the switching device can suitably be used to operate a metal halide lamp having a ceramic wall, then the limit value for comparing the signal Lvs preferably corresponds to a crest factor of at most 1.5. If the switching device can suitably be used to operate a metal halide lamp having a quartz glass wall, then the limit value preferably corresponds to a crest factor of at most 1.6. The term "crest factor" is to be taken to mean, in this description and in the claims, the ratio between the pulse height of the converter output voltage and the height of the plateau voltage of the converter output voltage. The term "ceramic wall" is to be taken to mean in the claims, a wall of a light-transmitting, densely sintered metal oxide, such as aluminum oxide and YAG, and of a light-transmitting metal nitride, such as AlN.

These and other aspects of the invention will be apparent from and elucidated with reference to the embodiment(s) described hereinafter.

In the drawings:

FIG. 1 shows a circuit device in accordance with the invention, and

Figure 2:
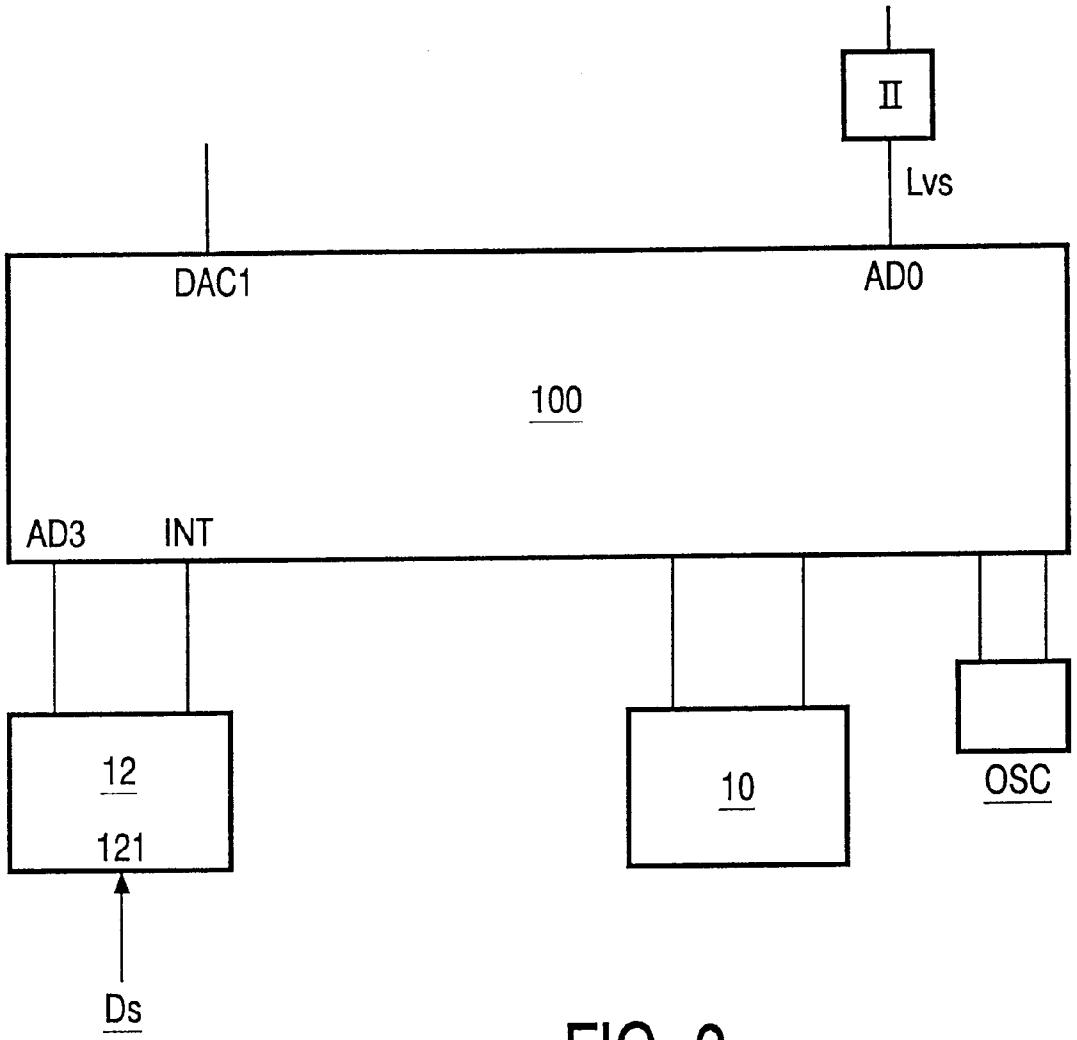
Figure 3A:
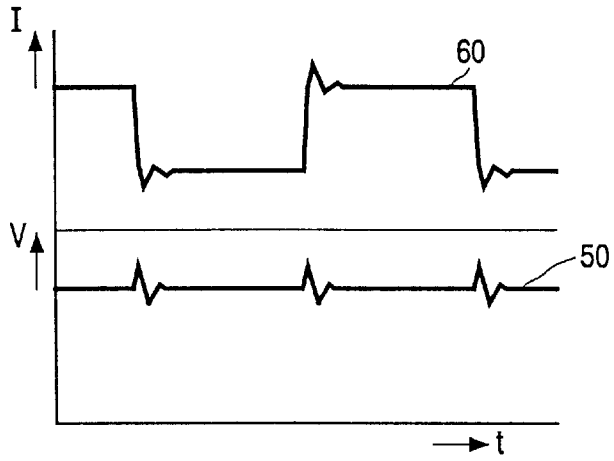
Figure 3B:
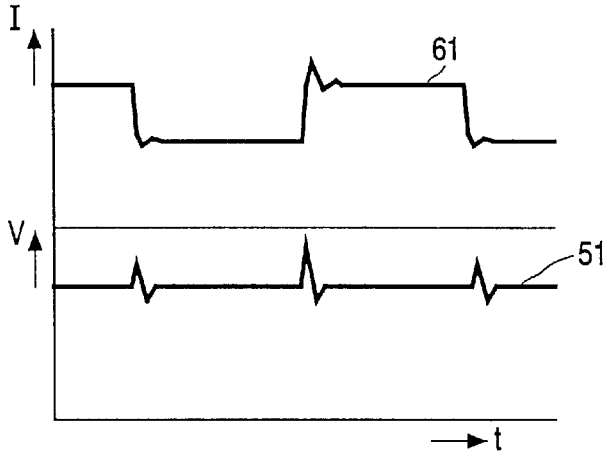
Figure 3C:
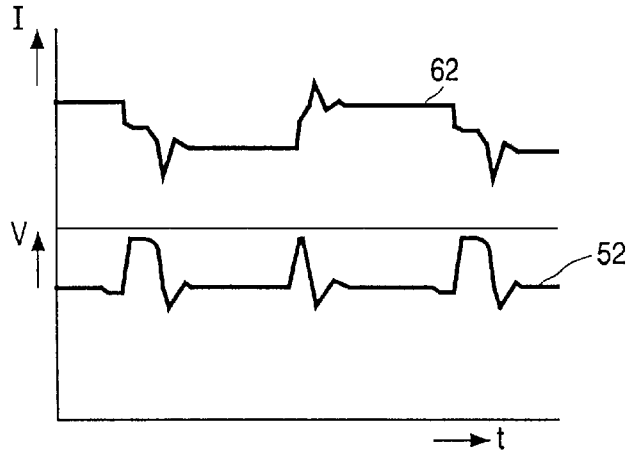
Figure 4A:
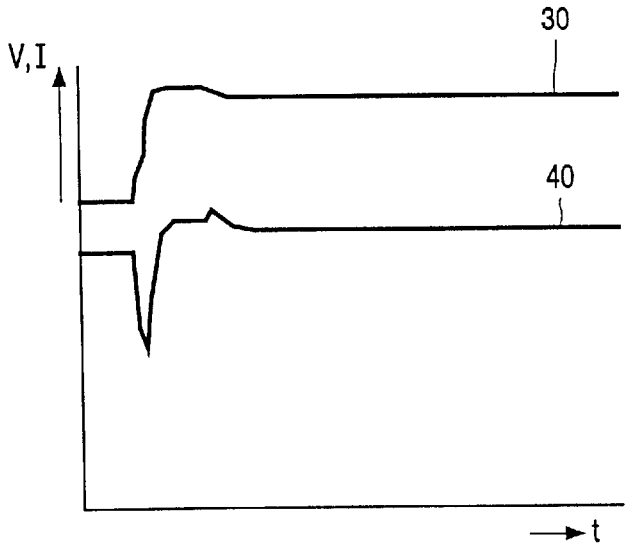
Figure 4B:
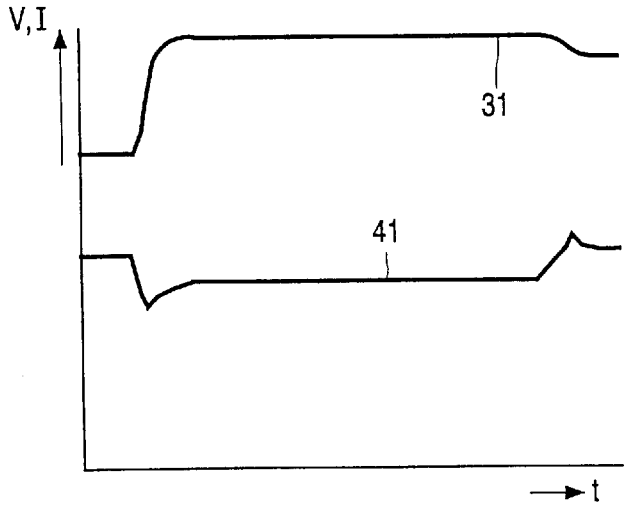
Figure 5A:
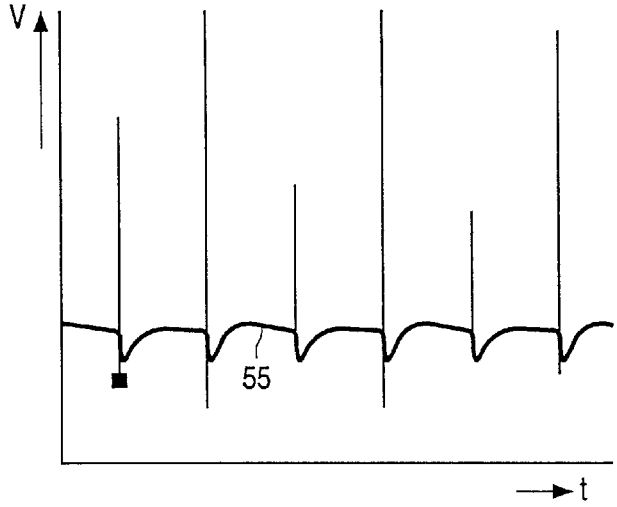
Figure 6A:
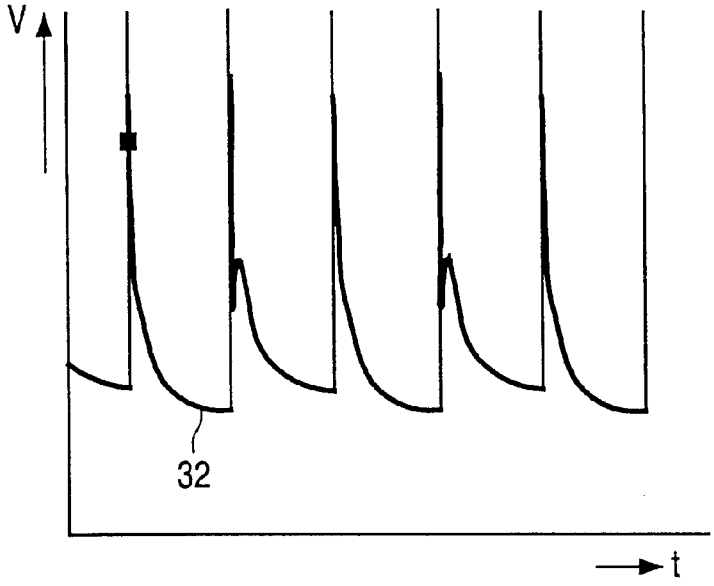
Figure 7:
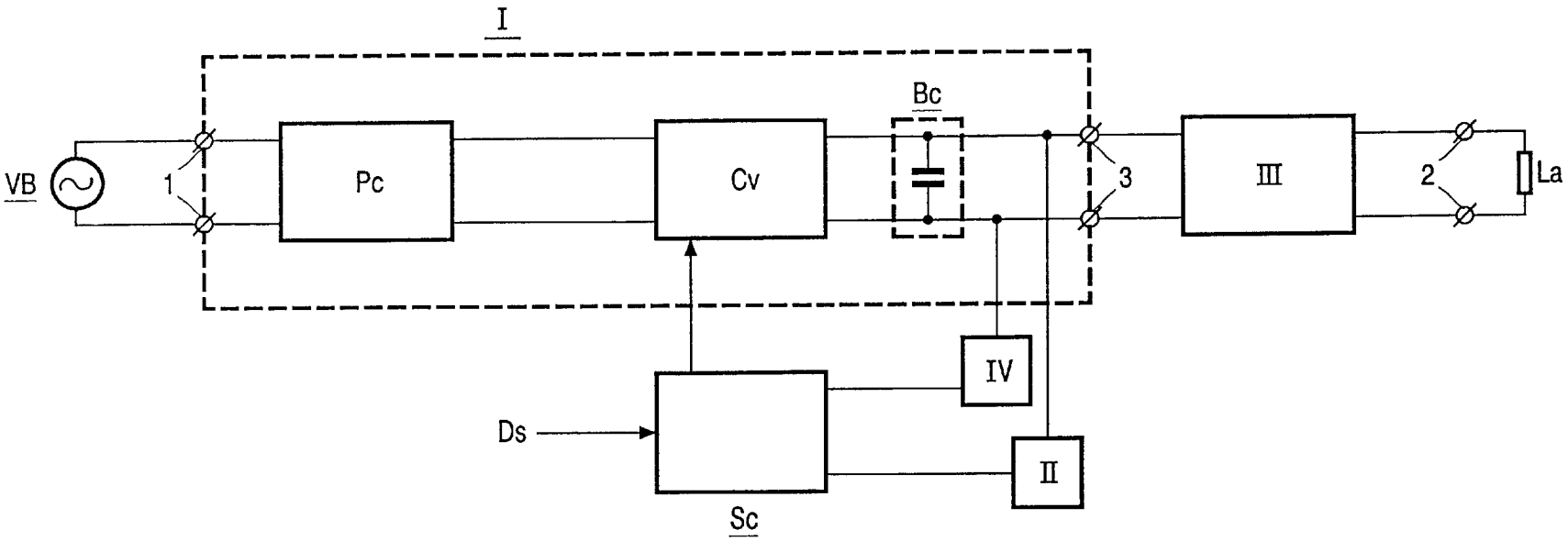

FIG. 2 shows a diagram of a control circuit of the circuit device shown in FIG. 1, FIG. 3 shows a graph of a converter output voltage-related signal Lvs for 3 different dimmed states of a circuit device in accordance with the invention, FIGS. 4A, B, C, D show graphs of the signal Lvs in further embodiments, FIGS. 5A, B show graphs of a plateau voltage of the signal Lvs in successive current phases, FIGS. 6A, B show graphs of a plateau voltage of the signal Lvs in a different embodiment, and FIG. 7 shows a diagram of a further embodiment of the circuit device in accordance with the invention.

FIG. 1 shows a circuit device for operating a high-pressure discharge lamp La with successive current phases, which circuit device is provided with means for operating the connected lamp in the dimmed state by means of a dimming signal Ds, said circuit device comprising:

- input terminals 1 for connecting the circuit device to a power supply source VB,
- output terminals 2 for connecting the lamp La to be operated,
- a switch-mode power supply I (smps) with a converter Cv provided with a semiconductor switch for generating, at a converter output 3, a converter output voltage across buffer capacitor means Cb and a converter output current, and
- a control circuit Sc for generating a control signal, in dependence upon the dimming signal, for controlling the semiconductor switch.

The circuit device also comprises means 11 for generating a converter output voltage-related signal Lvs intended to form the control signal.

In a practical embodiment of the circuit device in accordance with the invention, said circuit device can suitably be connected to a power supply source, for example an electricity grid of 220 V, 50 Hz, for operating a high-pressure discharge lamp, for example a MHC-type metal halide lamp, manufactured by Phillips. The smps of the circuit device is preferably provided with a preconditioner Pc. To operate the lamp with, preferably, successive current phases of alternating polarity, the circuit device is provided with a commutator III, which is connected, on the one hand, to the converter output 3 and, on the other hand, to the output terminals 2. The commutator is also provided with an ignition circuit.

FIG. 2 shows the control circuit Sc in greater detail. The control circuit Sc comprises a programmable processor in the form of an IC 100. The means II are connected to an ADC input AD0 of the IC 100. The converter output voltage-related signal Lvs is thus formed. An external oscillator OSC serving as a clock is connected to the IC. The IC is also connected to an external memory 10 wherein a table with reference values and characteristics regarding the lamp to be operated is incorporated, such as the rated lamp power, lamp voltage, permissible dimming rate, etc. A dim interface 12 is connected to an ADC input AD3 on the IC as well as to a digital input INT. The dimming signal Ds is applied to an input 121 of the dim interface 12. The circuit device can thus suitably be used to operate the connected lamp, the dimming signal Ds being either analog or digital. The control signal for controlling the switch of the converter, which control signal is generated in the control circuit, is applied to a DA output DAC1 of the IC 100.

In a practical embodiment of the circuit device described herein, the connected MHC lamp has a rated power of 70 W. The circuit device comprises a switch-mode power supply (smps) composed of a known combination of a preconditioner, in the form of a (step-)upconverter or boost converter and a Buck type converter or (step-) downconverter. The downconverter comprises a 960 nF buffer capacitor at its output and is connected to a commutator. The commutator is in the form of a bridge circuit. The commutator also includes an ignition circuit which is known per se. The control circuit comprises a 87LPC769 type IC, manufactured by Phillips, as the programmable processor. The output of the converter output voltage is connected to an ADC input pin (pin no. 2) of the IC via a resistive voltage divider. The external oscillator is embodied so as to be a quartz crystal oscillator. The external memory comprising the table with reference values, such as limit values and characteristics, is a 4K-bit EEPROM.

The IC is provided with software for carrying out the procedure described hereinbelow. After the lamp has been ignited and burns in a stable manner, detection of the converter output voltage takes place in the course of a current phase of the commutator. For this purpose, the signal Lvs is sampled. The size of the crest factor is determined from the ratio of the values thus obtained, which relate to the pulse height and the plateau voltage. The crest factor value thus obtained is compared to a reference or limit value, which is also stored in the EEPROM. As long as the crest factor value is smaller than the reference value, dimming of the lamp will be continued in accordance with the applied dimming signal Ds. If, however, the established crest factor exceeds the predetermined limit value, then the converter control is fixed, irrespective of whether the dimmed state corresponding to the applied dimming signal Ds has been attained. As regards the MHC type lamp having a rated power of 70 W, the maximum dimmed state which can thus be attained is 35 W. In FIG. 3, the above is explained by means of a graph of the converter output voltage-related signal Lvs for 3 different dimmed states. The horizontal axis of the Figure is the time axis, and the voltage V and the current I are plotted along the vertical axis. In the graph, the curves 50, 51 and 52 represent the signal Lvs, generated by the means II, over a period of 3 successive current phases for the lamp in, respectively, the nominal state, the maximum dimmed state and a dimmed state wherein the lamp only just keeps burning. By way of illustration, the associated current through the lamp is represented by means of the curves 60, 61 and 62, respectively. During nominal operation of the lamp, the crest factor is 1.34. In the maximum dimmed state, the value of the crest factor is 1.5. In said state, the flicker produced by the lamp only just remains unnoticed by the observer. If the lamp only just keeps burning, the crest factor is 1.6. In this state, the lamp exhibits a clearly noticeable and disturbing flicker.

Figure 4C:
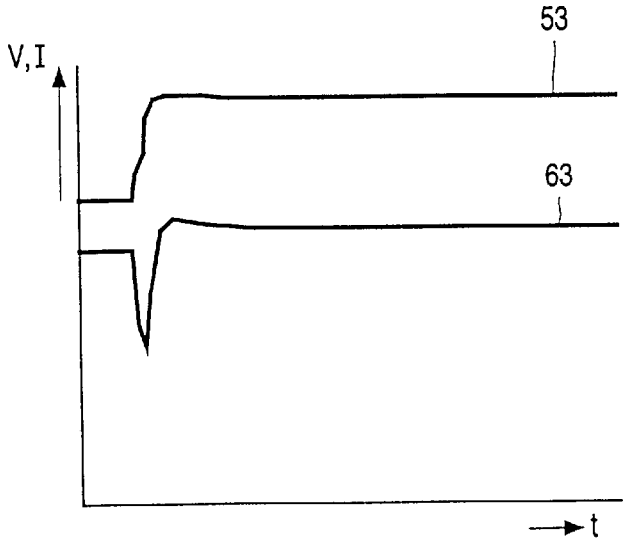
Figure 4D:
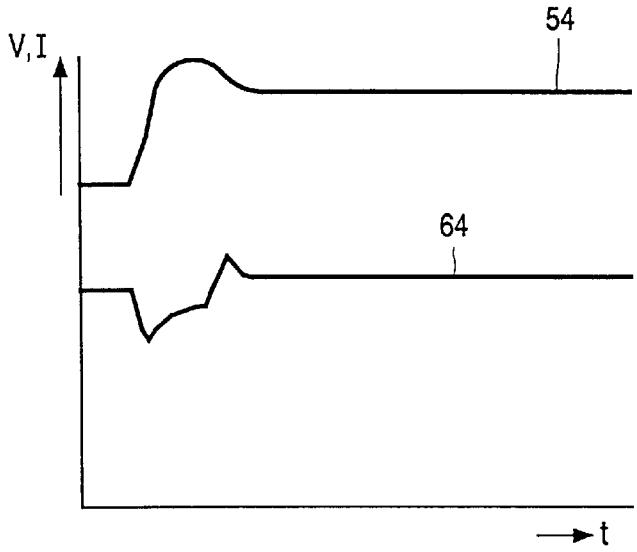

In another embodiment, the programmable processor is programmed such that detection of the pulse width of the signal Lvs serves as a quantity for determining whether the maximum permissible dimmed state has been achieved. This is explained in greater detail by means of FIG. 4. In FIGS. 4A and B, respectively, reference numerals 30, 31 represent curves of the signal Lvs during an initial fraction of a current phase for operating a metal halide lamp having a CDM type ceramic lamp vessel, manufactured by Phillips, having a rated power of 70 W, in, respectively, the nominal operating state and a dimmed state of 35 W. The Figures clearly show that the signal in the dimmed state assumes a high value for a long period of time. In the case shown, the period over which the signal Lvs exhibits a high value is 80 $\mu$s, which is the maximum permissible time period. For comparison, the current through the lamp is indicated in curves 40, 41. FIGS. 4C and 4D show, for a MHW type metal halide lamp having a quartz glass discharge vessel and a rated power of 70 W, manufactured by Phillips, the signal Lvs for the nominal operating state and a dimmed state of 35 W, indicated by means of curve 53 and 54, respectively, and the current through the lamp over a comparable period of time indicated by means of the curves 63 and 64, respectively.

Figure 5B:
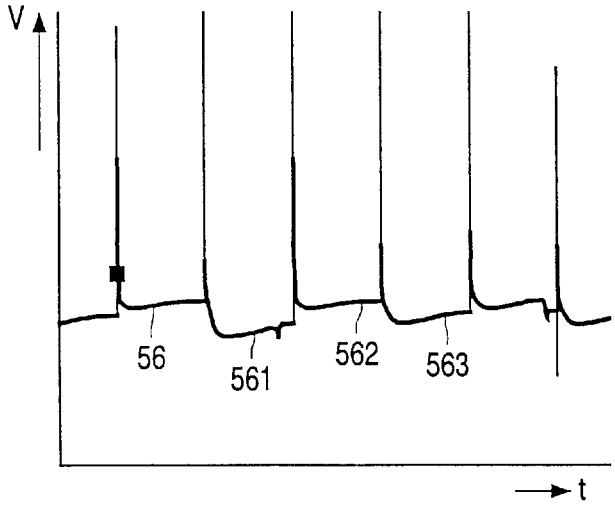

Other ways in which the programmable processor can establish the maximum permissible dimmed state are based on detection of the plateau voltage of the signal Lvs. In a first modification, detection takes place of the difference in plateau voltage of the signal Lvs in successive current phases. In another modification, detection takes place of fluctuations in the plateau voltage of the signal Lvs within one current phase. This is explained by means of FIGS. 5 and 6. In FIG. 5A and FIG. 5B, curve 55 and 56 show, respectively, the signal Lvs for 7 successive current phases in the nominal operating state and in a dimmed state of 35 W for the MHW lamp having a rated power of 70 W. FIG. 5B clearly shows that the value of the plateau voltage 561, 562, 563 of the signal Lvs differs in successive current phases.

Figure 6B:
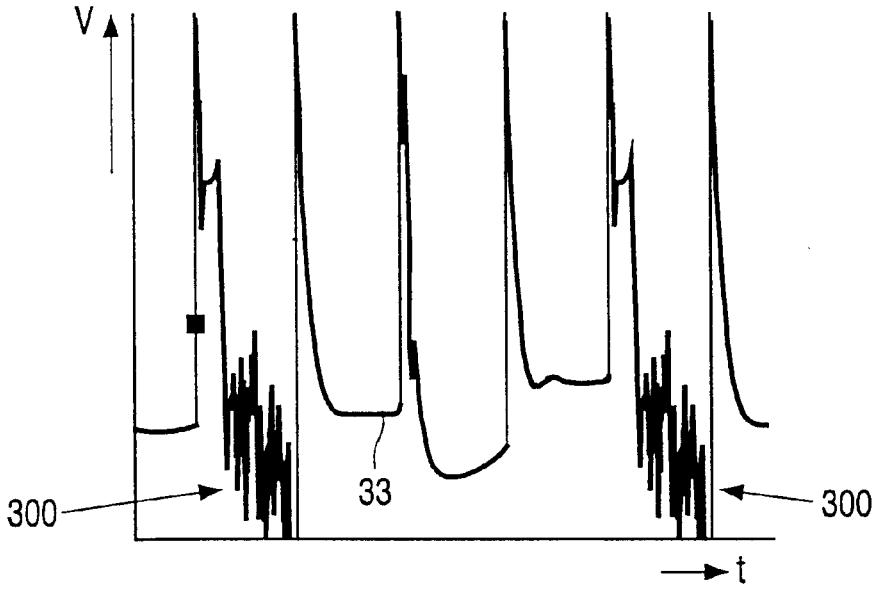

In the case of the CDM lamp having a rated power of 70 W, FIG. 6A and FIG. 6B show, respectively, the signal Lvs for 7 successive current phases in the nominal operating state and in a dimmed state of 35 W by means of curve 32 and curve 33, respectively. FIG. 6B clearly shows that the plateau voltage of the signal Lvs exhibits fluctuations 300 within some of the current phases.

The diagram of FIG. 7 shows a further modification of the circuit device in accordance with the invention, wherein the parts corresponding to the diagram in accordance with FIG. 1 are indicated by means of a corresponding reference numeral. Said modification of the circuit device comprises means IV for generating a converter output current-related signal Icu to form the control signal. By means of the signals Lvs and Icu, a power signal Sv is formed, for example, by multiplying the signals Lvs and Icu. The power signal Sv is subsequently compared with a reference power value which depends on the dimming signal Ds, and the result of the comparison is used to form the control signal for controlling the semiconductor switch of the converter. Detection of the maximum permissible dimmed state can be advantageously realized by limiting the value of the power signal Sv immediately after the start of each current phase.

What is claimed is:

1. A circuit device for operating a high pressure discharge lamp with successive current phases, said circuit device operates the connected lamp in a dimmed state in accordance with a dimming signal, said circuit device comprising:

input terminals for connecting said circuit device to a power supply source;

output terminals for connecting said circuit device to the lamp to be operated;

a switch-mode power supply with a converter provided with a semiconductor switch for generating, at a converter output, a converter output voltage across a buffer capacitor and a converter output current;

a control circuit for generating a control signal in dependence upon the dimming signal for controlling the semiconductor switch; and means for generating a converter output voltage-related signal to form the control signal.

2. The circuit device as claimed in claim 1, wherein said control circuit is provided with means for comparing the signal with a limit value.

3. The circuit device is claimed in claim 1, wherein said control circuit comprises programmable processor.

4. The circuit device as claimed in claim 1, wherein, at the start of each current phase, the converter output voltage is pulse-shaped with a pulse height, and the converter output voltage-related signal serves to detect the pulse height.

5. The circuit device as claimed in claim 1, wherein, at the start of each current phase, the converter output voltage is pulse-shaped with a pulse width, and the converter output voltage-related signal serves to detect the pulse width.

6. The circuit device as claimed in claim 1, wherein, at the start of each current phase, the converter output voltage is pulse-shaped, followed by a plateau voltage, and the converter output voltage-related signal serves to detect the plateau voltage.

7. The circuit device as claimed in claim 6, wherein the converter output voltage-related signal serves to detect the plateau voltage difference in successive current phases.

8. The circuit device as claimed in claim 6, wherein the converter output voltage-related signal serves to detect fluctuations in the plateau voltage within a current phase.

9. The circuit device as claimed in claim 2, wherein said circuit device can suitably be used to operate a metal halide lamp having a ceramic wall, and in that the limit value for comparing the converter output voltage-related signal corresponds to a crest factor of at most 1.5.

10. The circuit device as claimed in claim 2, wherein said circuit device can suitably be used to operate a metal halide lamp having a quartz glass wall, and in that the limit value for comparing the converter output voltage-related signal corresponds to a crest factor of at most 1.6.

11. The circuit device as claimed in claim 1, further comprising:

means for generating a converter output current-related signal to form the control signal.

12. The circuit device as claimed in claim 11, wherein a power signal is formed from the converter output voltage-related signal and the converter output current-related signal, said power signal used to form the control signal.

13. A circuit device for operating a high pressure discharge lamp with successive current phases and in a dimmed state in accordance with a dimming signal, said circuit device comprises:

input terminals for connecting said circuit device to a power supply source;

output terminal for connecting said circuit device to the high pressure discharge lamp;

a switch-mode power supply between said input terminals and said output terminals, said switch-mode power supply including a buffer capacitor, and a converter for generating a converter output voltage across said buffer capacitor in response to a control signal;

a control circuit for generating the control signal in dependence upon the dimming signal and a converter output voltage-related signal;

means for generating the converter output voltage-related signal.

14. The circuit device of claim 13, wherein said control circuit compares the converter output voltage-related signals to a limited value when generating the control signal.

15. The circuit device of claim 13, wherein the converter output voltage is pulse-shaped with a pulse height at the start of each current phase of the successive current phases; and wherein said control circuit utilizes the converter output voltage-related signal to detect the pulse height of the converter output voltage.

16. The circuit device of claim 13, wherein the converter output voltage is pulse-shaped with a pulse width at the start of each current phase of the successive current phases; and wherein said control circuit utilizes the converter output voltage-related signal to detect the pulse width of the converter output voltage.

17. The circuit device of claim 13, wherein the converter output voltage is pulse-shaped at the start of each current phase of the successive current phases and a plateau voltage thereafter; and wherein said control circuit utilizes the converter output voltage-related signal to detect the pulse width of the plateau voltage.

18. The circuit device of claim 13, wherein the converter output voltage is pulse-shaped at the start of each current phase of the successive current phases and a plateau voltage thereafter; and wherein said control circuit utilizes the converter output voltage-related signal to detect the pulse width of the plateau voltage.

19. The circuit device of claim 18, further comprising:

means for generating a converter output current-related signal, wherein said control circuit generates the control signal in dependence upon the dimming signal, the converter output voltage-related signal and the converter output current-related signal.

20. The circuit device of claim 19, wherein said control circuit generates a power signal as a function of the converter output voltage-related signal and the converter output current-related signal; and wherein said control circuit compares the power signal to a limited value when generating the control signal.

* * * * *